US006217019B1

(12) United States Patent
Ishiduka et al.

(10) Patent No.: US 6,217,019 B1
(45) Date of Patent: Apr. 17, 2001

(54) RECORDING SHEET PACKAGE

(75) Inventors: Yoshio Ishiduka, Kanagawa; Yasushi Kikuchi, Shizuoka, both of (JP)

(73) Assignee: Fuji Photo Film Co. Ltd., Kanagawa (JP)

( * ) Notice: Subject to any disclaimer, the term of this patent is extended or adjusted under 35 U.S.C. 154(b) by 0 days.

(21) Appl. No.: 09/425,616

(22) Filed: Oct. 22, 1999

(30) Foreign Application Priority Data

Oct. 23, 1998 (JP) ..... 10-303063

(51) Int. Cl.[7] ..... B65H 1/08

(52) U.S. Cl. ..... 271/147; 271/145; 271/127; 206/449; 206/556

(58) Field of Search ..... 206/449, 456, 206/556; 271/145, 147, 157, 166, 127; 378/182; 396/517

(56) References Cited

U.S. PATENT DOCUMENTS

| | | | | |
|---|---|---|---|---|
| 4,734,704 | | 3/1988 | Mizutani et al. | 346/76 |
| 4,763,891 | * | 8/1988 | Kodama | 271/157 |
| 4,830,354 | * | 5/1989 | Penson | 271/147 |
| 4,833,488 | | 5/1989 | Mizutani et al. | 346/76 |

FOREIGN PATENT DOCUMENTS

| | | | | |
|---|---|---|---|---|
| 0037937 | * | 4/1981 | (JP) | 271/127 |
| 61-213169 | | 9/1986 | (JP) | B41J/3/20 |
| 0197232 | * | 8/1989 | (JP) | 271/145 |
| 5-116774 | | 5/1993 | (JP) | B65H/1/26 |

* cited by examiner

*Primary Examiner*—H. Grant Skaggs
(74) *Attorney, Agent, or Firm*—Sughrue, Mion, Zinn, Macpeak & Seas, PLLC

(57) ABSTRACT

A recording sheet package containing a pile of recording sheets in a box-shaped casing. The casing has a paper feed-out opening formed in one end thereof, and a feed roller entrance formed through a top wall of the casing in connection to the paper feed-out opening, for allowing feed rollers to access a topmost one of the piled recording sheets. The recording sheets are piled up on the movable bottom plate that is disposed on a bottom wall of the casing, so as to be able to flap up and down relative to the bottom wall. A push-up plate entrance is formed through the bottom wall in connection to the paper feed-out opening, for allowing a push-up plate of a paper feeding cassette to push up the movable bottom plate and press the topmost recording sheet onto the feed roller. A pressing plate is disposed under the top wall so as to be able to flap up and down relative to the top wall. The pressing plate presses the pile of recording sheets onto the movable bottom plate, so the pile of recording sheets is tightly held between these members. The casing is made from a cardboard paper having a moisture tight polymeric layer formed on one side thereof, such that the moisture tight polymeric layer is oriented outward of the casing.

13 Claims, 13 Drawing Sheets

RECORDING SHEET PACKAGE

BACKGROUND OF THE INVENTION

1. Field of the Invention

The present invention relates to a recording sheet package for a thermal printer, especially for a direct thermal printer that directly heats a thermosensitive recording sheet to print an image thereon.

2. Background Arts

Thermal printers may be roughly classified into two types: direct thermal printing type and thermal transfer type. The thermal transfer type includes wax transfer type and sublimation type. For each type printer, a particular type of recording sheet is used. The wax transfer type printer melts or softens ink on ink film, and transfers it to the recording paper. The sublimation type printer sublimates or disperses dye of ink film onto the recording sheet. The recording sheet for the wax transfer type consists of paper coated with a smoothing layer. The recording sheet for the sublimation type consists of paper coated with polyester resin.

The thermosensitive recording sheet for the direct thermal printing is usually provided for a full-color printing. For example, JPA 61-213169 discloses a thermosensitive color recording sheet. The thermosensitive color recording sheet is constituted of a support layer and at least three coloring layers overlaid thereon which respectively develop cyan, magenta and yellow when heated up to different temperature ranges from each other. Thus, gradually increasing heat energies are applied to the thermosensitive recording sheet to develop three colors sequentially from the most thermosensitive coloring layer to the least thermosensitive coloring layer. Each coloring layer after developing color is optically fixed prior to the thermal coloring of the next coloring layer, so that the just colored layer may not develop color any more even while it is heated by the heat energies applied for the next coloring layer. For this optical fixation, ultraviolet rays of a predetermined wavelength range are applied to the thermosensitive recording sheet, to destroy the coloring ability of the colored layer.

Because of the photosensitivity to the ultraviolet rays, if the thermosensitive recording sheet is exposed to ambient light or light from a widely used fluorescent lamp or the like, for a certain time, the coloring ability is remarkably deteriorated. For this reason, the thermosensitive recording sheets must be preserved in a light-tight fashion. Moreover, since moisture has a great influence on printing quality in either type of recording sheet, it is desirable to protect the recording sheets from moisture as well as light even after they are loaded in the thermal printer, not to mention during their shipment and preservation.

To use the recording sheets, they are ordinarily loaded in a paper feeding cassette that is attached to a thermal printer. On loading the recording sheets in the paper feeding cassette, there have been risks of placing the recording sheets in a wrong posture, soiling the recording surface by the user's hand, or exposing the recording sheet to ambient light of an intolerable amount. Beside that, it has been uneasy to pile up the recording sheets neatly in the paper feeding cassette. If the recording sheets are loosely loaded, the recording sheets tend to get jammed in the printer.

To facilitate loading the recording sheets safely in a right posture, many types of recording sheet packages containing a pile of recording sheets in a casing have been suggested. JPA 5-116774 discloses a recording sheet package, wherein a portion of the casing is cut off along a line of cutting perforations to provide a paper feed-out opening for the recording sheet, and thereafter the package is loaded in a paper feeding cassette. The recording sheets are protected from light and moisture while being contained in the casing, and the users need not touch the recording sheets to load the recording sheets. However, the need for cutting the casing along the perforations makes this recording sheet package inconvenient.

Furthermore, in the recording sheet package of this prior art, an opening is formed through a bottom wall of the casing in connection to the paper feed-out opening concurrently with the paper feed-out opening being formed by cutting off the predetermined portion of the package casing. This bottom opening permits a push-up member to push up the recording sheets and presses the topmost recording sheet of the pile onto feed rollers that are inserted into the casing from upside of the paper feed-out opening. Therefore, this recording sheet package cannot sufficiently protect the recording sheets from light, moisture and dusts when it is unloaded from the paper feeding cassette. However, if the pile of recording sheets is not pressed onto these feed rollers by such a push-up member, the feed roller could not feed out the recording sheet when the remainder of recording sheets in the package reduces to a certain amount. Also, the piled recording sheets would be loosened, so the light-tightness and the moisture-tightness would be lowered as the remaining number of recording sheets decreases.

SUMMARY OF THE INVENTION

In view of the foregoing, an object of the present invention is to provide a recording sheet package, which continues to protect the contained recording sheets from light, moisture and dusts, and prevents the pile of the recording sheets from loosening even after the remainder of recording sheets decreases.

To achieve the above and other object, according to the present invention, a recording sheet package containing a pile of recording sheets in a box-shaped casing is comprised of a paper feed-out opening formed in one end of the casing; a feed roller entrance formed through a top wall of the casing in connection to the paper feed-out opening, for allowing a feed roller of the paper feeding cassette or that of the thermal printer to access a topmost one of the piled recording sheets; a movable bottom plate on which the recording sheets are piled up, the movable bottom plate being disposed on a bottom wall of the casing that extends parallel to the top wall, so as to be able to flap up and down relative to the bottom wall; a push-up plate entrance formed through the bottom wall in connection to the paper feed-out opening, for allowing a push-up plate of the paper feeding cassette to push up the movable bottom plate and press the topmost recording sheet onto the feed roller; and a pressing plate disposed under the top wall so as to be able to flap up and down relative to the top wall, the pressing plate pressing the pile of recording sheets onto the movable bottom plate.

Because the pile of recording sheets is clamped between the movable bottom plate and the pressing plate, the recording sheets are maintained neat and tight even after the number of recording sheets in the casing reduces.

According to a preferred embodiment, the movable bottom plate is sized to be equal to or slightly larger than the recording sheet. By piling up the recording sheets with their recording surfaces oriented toward the movable bottom plate, the recording surface of the bottom recording sheet in the pile is kept in tight contact with the movable bottom plate, so is protected from ambient light.

According to a preferred embodiment, the casing is made from a cardboard paper having a moisture tight polymeric layer formed on one side thereof, such that the moisture tight polymeric layer is oriented outward of the casing. Thereby, the polymeric layer blocks ambient moisture from entering the interior of the casing, while the interior of the casing is maintained at an approximately constant humidity because of the moisture absorption property of the cardboard paper itself.

To protect the recording sheets, especially the thermosensitive recording sheets as having a specific photosensitivity, from being affected by ambient light, the cardboard paper preferably has a permeability of not more than 1% to light of a wavelength range from 300 nm to 500 nm.

BRIEF DESCRIPTION OF THE DRAWINGS

The above and other objects and advantages of the present invention will become apparent from the following detailed description of the preferred embodiments when read in connection with the accompanying drawings, which are given by way of illustration only and thus are not limiting the present invention, wherein like reference numerals designate like or corresponding parts throughout the several views, and wherein.

DETAILED DESCRIPTION OF THE PREFERRED EMBODIMENT

Figure 1:
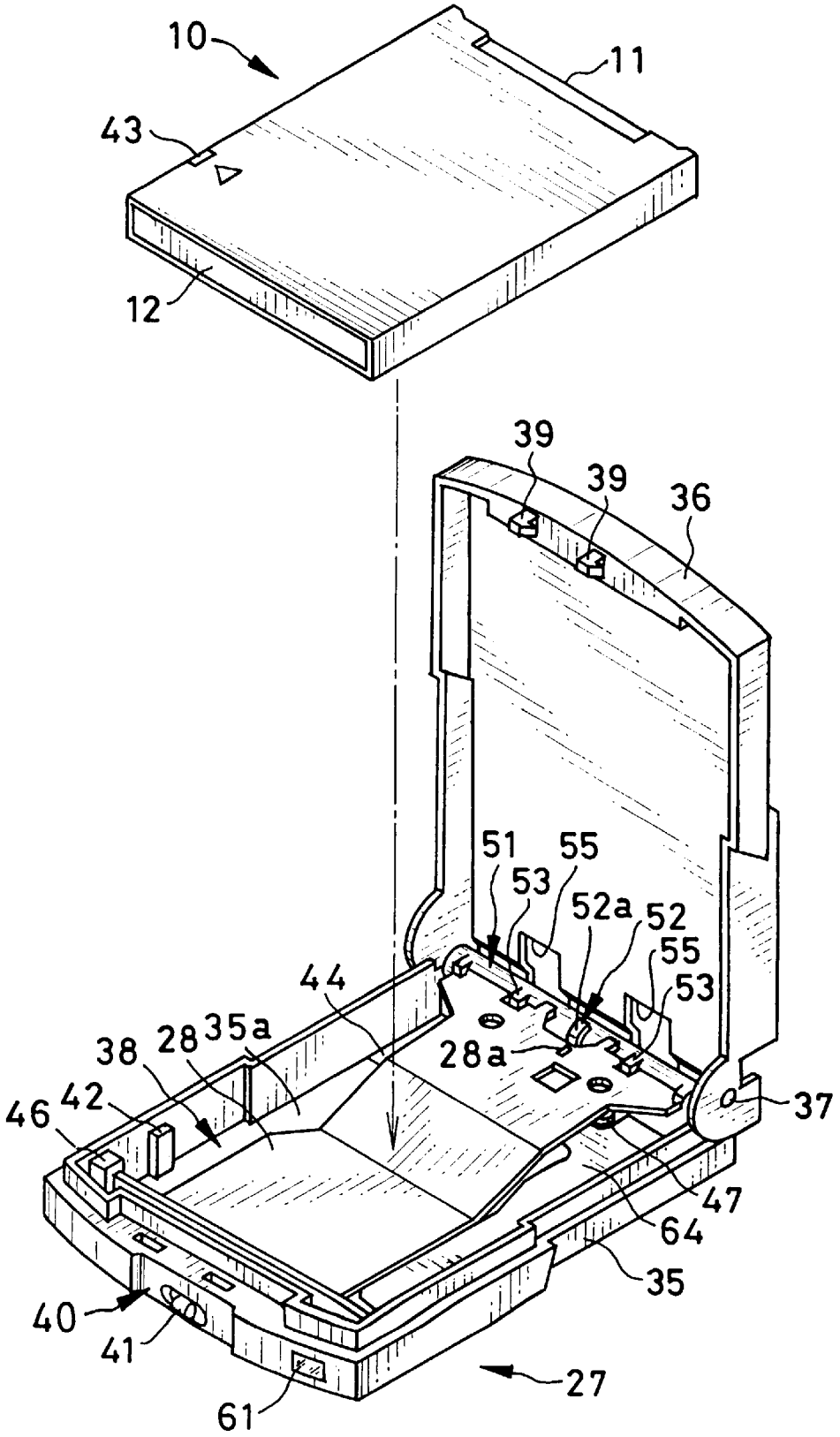
FIG. 1 is a perspective view of a recording sheet package according to an embodiment of the invention, and a paper feeding cassette for use with the recording sheet package.

In FIG. 1, a recording sheet package 10 contains a pile of recording sheets 11, e.g. thermosensitive color recording sheets, in a flat box-shaped casing 12. The recording sheet package 10 is loaded in a paper feeding cassette 27, and the paper feeding cassette 27 is attached to a thermal printer to feed the recording sheets 11 one after another to the thermal printer.

Figure 2:
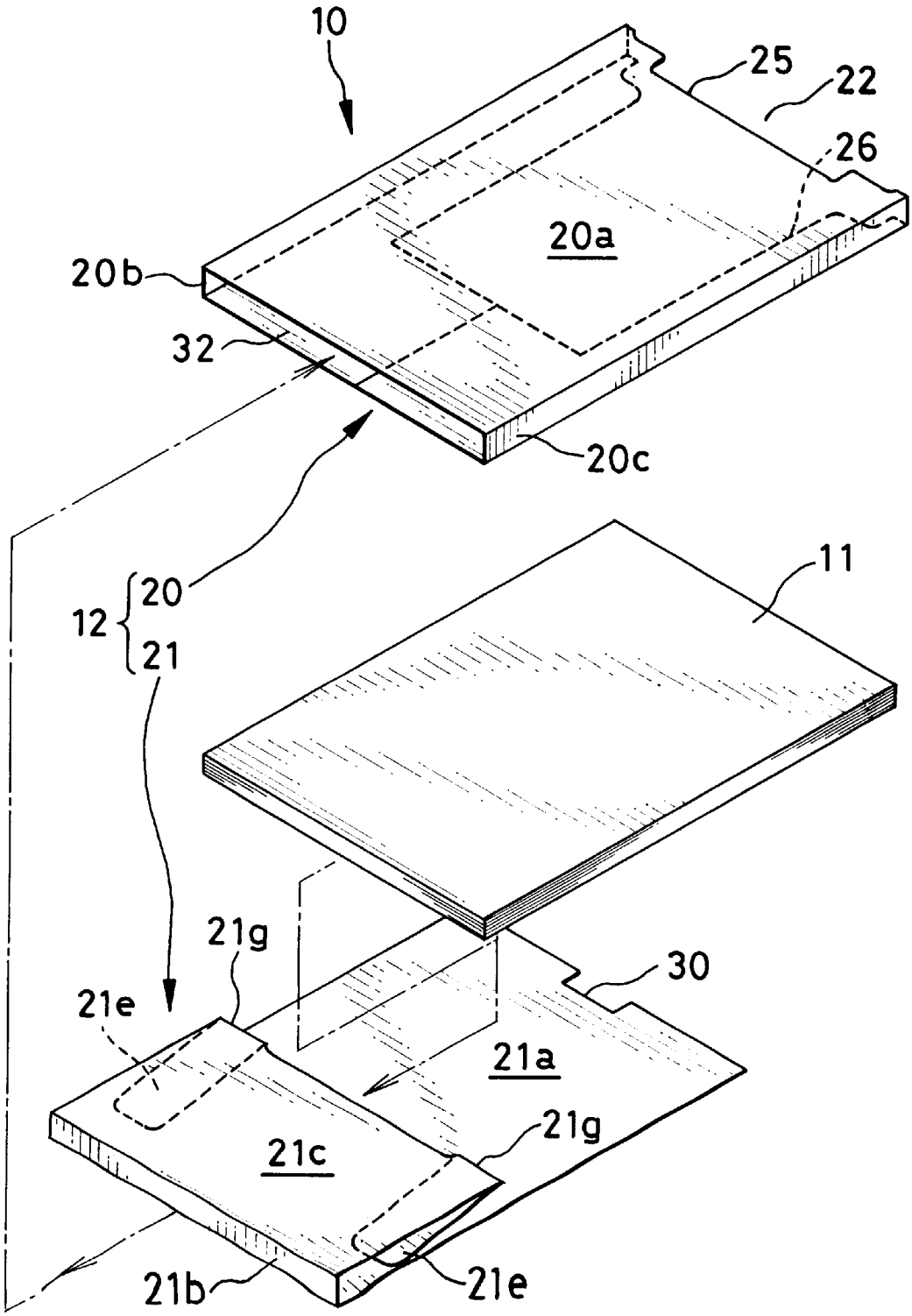
FIG. 2 is an exploded perspective view of the recording sheet package of FIG. 1, wherein a casing of the recording sheet package consists of an outer casing member and an inner casing member.

As shown in FIG. 2, the casing 12 consists of a outer casing member 20 and an inner casing member 21 that is inserted into the outer casing member 20.

Figure 3A:
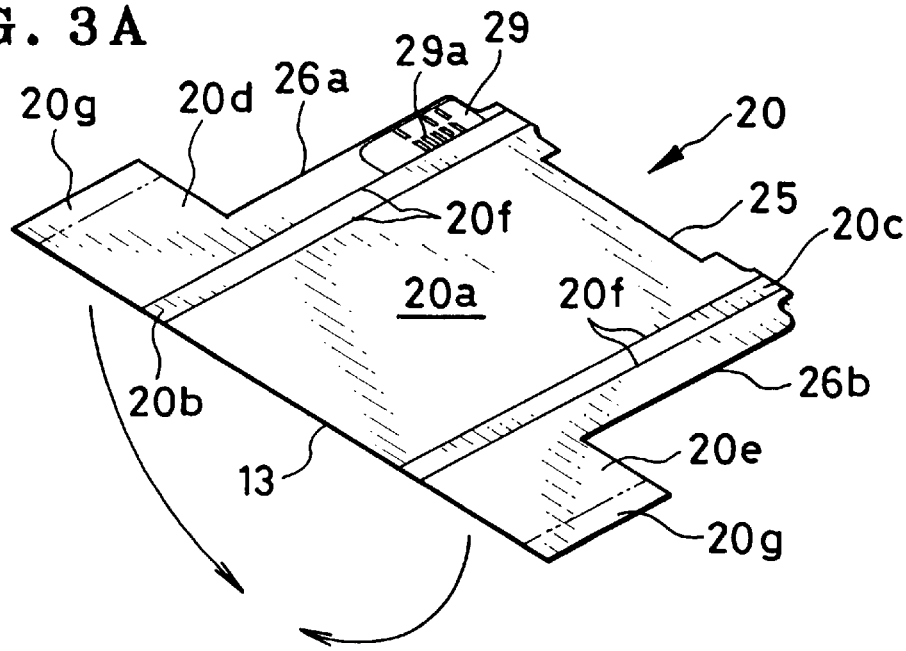
FIGS. 3A, 3B and 3C are explanatory diagrams illustrating how to make the outer casing member of the recording sheet package.
Figure 3B:
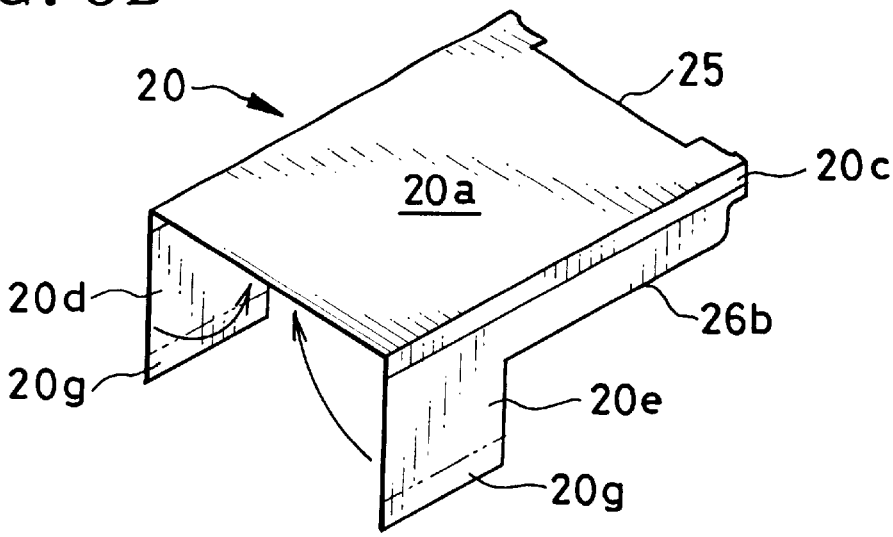
Figure 3C:
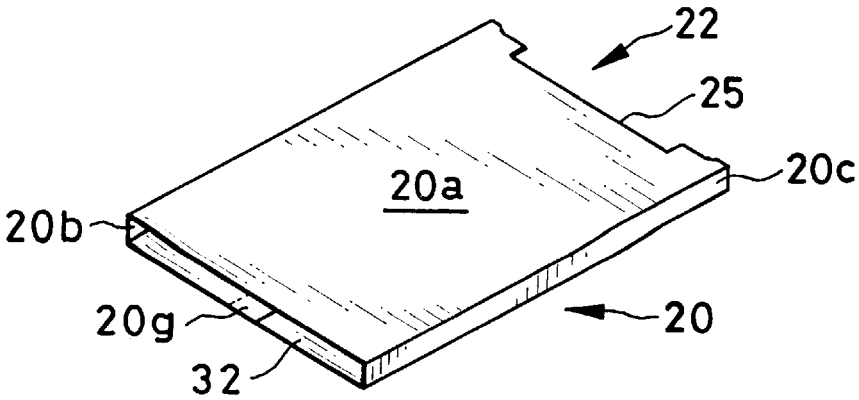

As shown in FIGS. 3A to 3C, the outer casing member 20 is made from a blanked piece of cardboard paper 13 by folding the cardboard paper 13 along folding lines 20*f* at an angle of 90°. Thereby, the cardboard paper 13 is sectioned into a top wall 20*a,* side walls 20*b* and 20*c,* and a pair of bottom wall halves 20*d* and 20*e.* By mating and bonding paste margins 20*g* of the bottom wall halves 20*d* and 20*e* to each other, the outer casing member of a flat rectangular barrel shape is provided.

Figure 4A:
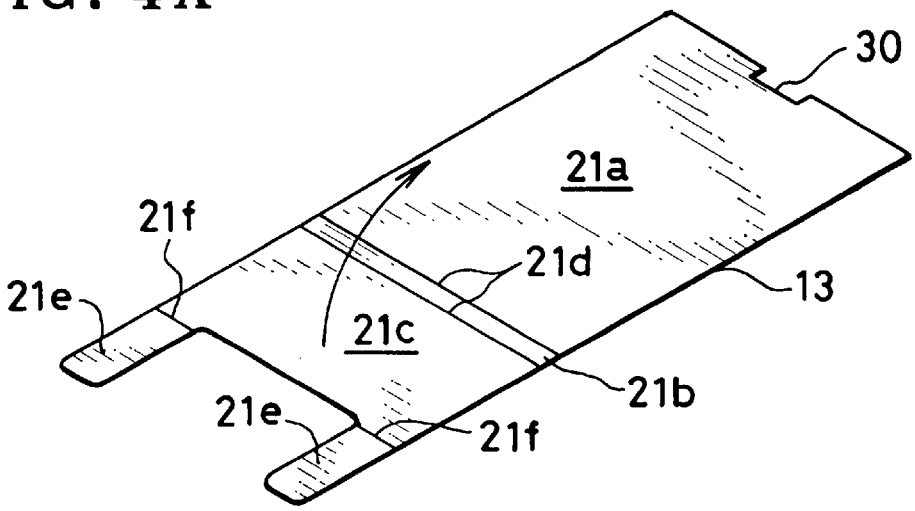
FIGS. 4A, 4B and 4C are explanatory diagrams illustrating how to make the inner casing member of the recording sheet package.
Figure 4B:
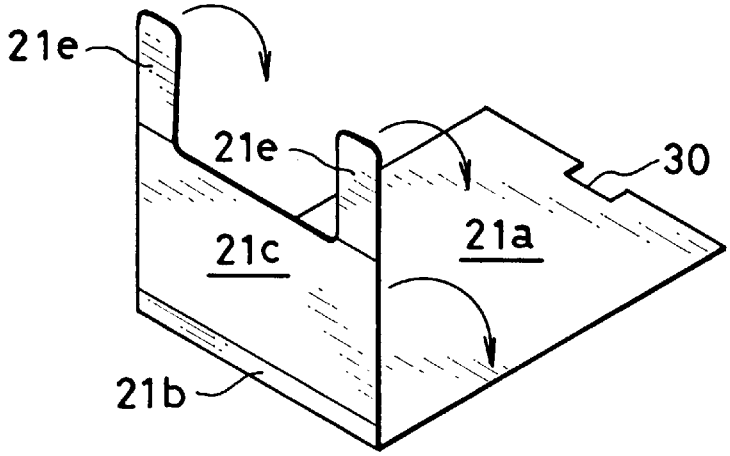
Figure 4C:
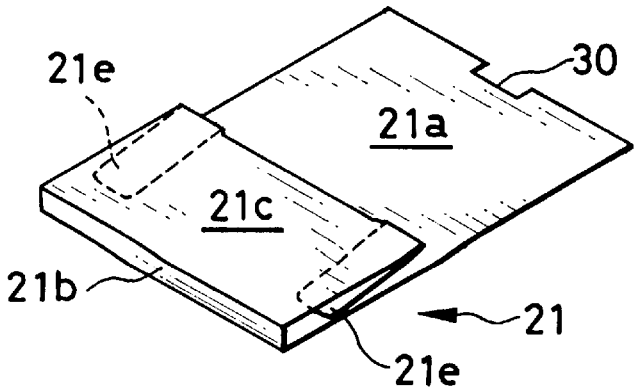

As shown in FIGS. 4A to 4C, the inner casing member 21 is also made from a blanked piece of the same cardboard paper 13 as the outer casing member 20. By folding the blanked piece along folding lines 21*d* at an angle of 90°, the cardboard paper 13 is sectioned into a movable bottom plate 21*a,* an end wall portion 21*b* and a pressing plate 21*c.* Furthermore, by folding the pressing plate 21*c* inward along folding lines 21*f,* a pair of spring flaps 21*e* are provided.

The inner casing member 21 is inserted into the outer casing member 20 through an open end 32. The end wall portion 21*b* of the inner casing member 21 closes the open end 32, and extends beyond the open end 32 on either side of the casing 12 by a length equal to a thickness of the cardboard paper 13. Thereby, the extended portions of the end wall portion 21*b* strike against end edges of the side walls 20*b* and 20*c* at the end of insertion of the inner casing member 21 into the outer casing member 20, and stop the inner casing member 21 from sliding further into the outer casing member 20. It is desirable to secure the inner casing member 21 to the outer casing member 20 through adhesive tapes or the like.

The movable bottom plate 21*a* is equal to or slightly larger than the recording sheet 11, and is smoothly movable inside the outer casing member 20.

The recording sheets 11 are piled in between the movable bottom plate 21*a* and the pressing plate 21*c*. Since the spring flaps 21*e* are bent into between the pressing plate 21*c* and the movable bottom plate 21*a,* the spring flaps 21*e* urge the recording sheets 11 toward the movable bottom plate 21*a* because of a stiffness of the cardboard paper 13. Thus, the pile of the recording sheets 11 is held between the movable bottom plate 21*a* and the spring flaps 21*e.* The number of recording sheets 11 primary contained in the casing 12 depends on the thickness of the recording sheet 11.

Especially for the thermosensitive recording sheet whose recording surface is photosensitive, it is preferable to orient the recording surfaces of the recording sheets 11 downward, i.e. toward the movable bottom plate 21*a.* Thereby, the recording surface of the bottommost recording sheet 11 of the pile is kept in tight contact with the movable bottom plate 21*a*. So the recording surfaces of the recording sheets 11 of the package 10 are prevented from being exposed to light.

Figure 5:
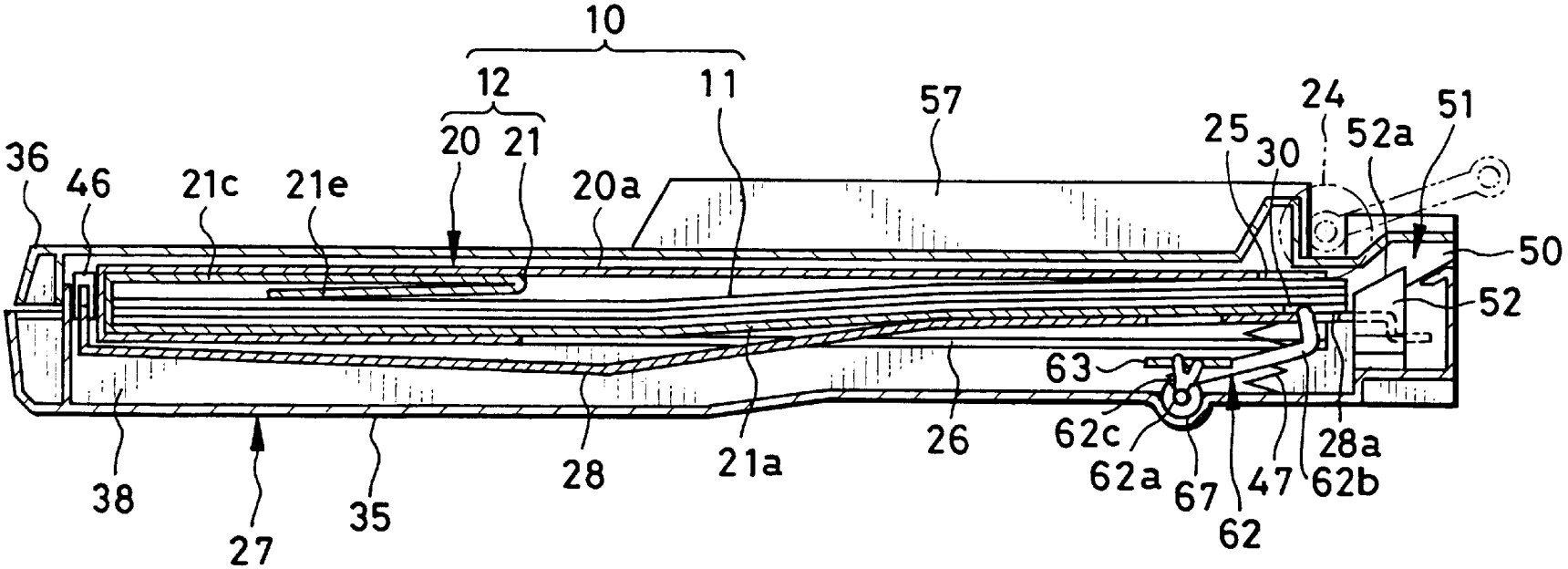
FIG. 5 is a sectional view of the recording sheet package loaded in the paper feeding cassette.

Another open end 22 of the outer casing member 20 is used as a paper feed-out opening, so an end edge of the top wall 20*a* in the side of the paper feed-out opening 22 is partly cutout to provide a feed roller entrance 25 for permitting feed rollers 24 of the thermal printer to access the recording sheets 11, as is implied in FIG. 5.

The bottom wall halves 20*d* and 20*e* are each formed with a cutout 26*a* or 26*b* in connection to the paper feed-out opening 22, and these cutouts 26*a* and 26*b* constitute a push-up plate entrance 26 when the bottom wall halves 20*d* and 20*e* are bonded to each other, as shown in FIG. 2. As will be described in detail later, a push-up plate 28 of the paper feeding cassette 27 enters in the push-up plate entrance 26, and pushes up the movable bottom plate 21*a* thereby to press the topmost recording sheet 11 onto the feed rollers 24, as shown in FIG. 5.

A cutout 30 formed in the end edge of the movable bottom plate 21*a* is for inserting a paper remainder detection lever 62 of the paper feeding cassette 27, as shown in FIG. 5. The paper remainder detection lever 62 detects an amount of the recording sheets 11 remaining in the recording sheet package 10, as will be described in detail later.

Figure 6:
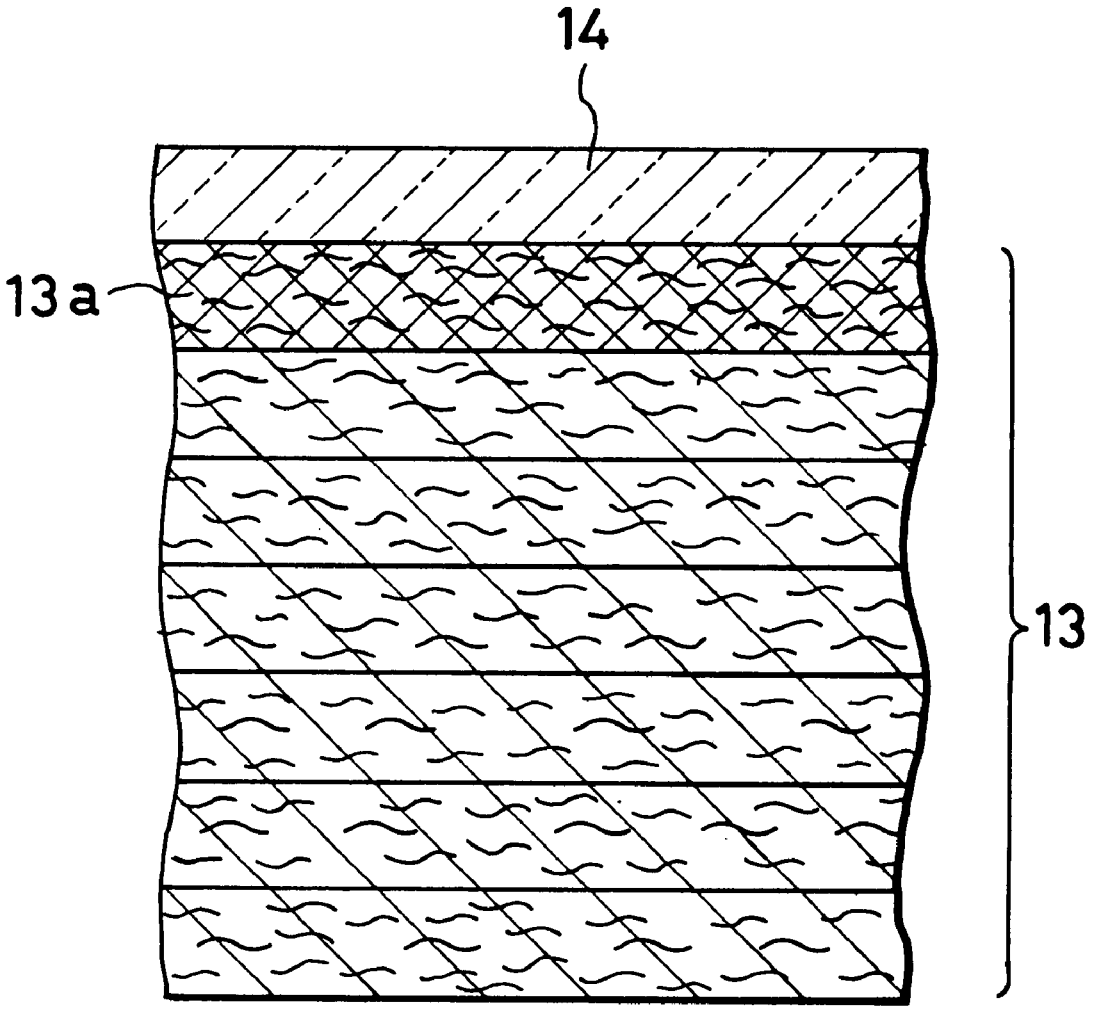
FIG. 6 is an explanatory diagram illustrating a layered structure of a cardboard paper as a material of the casing of the recording sheet package.

The cardboard paper 13 has a layered structure, as shown in FIG. 6, that is usually constructed during the paper manufacturing. Since the recording sheet 11 is photosensitive, particularly to ultraviolet or near-ultraviolet rays, it is preferable to give a light shielding property to the cardboard paper 13. Specifically, the cardboard paper 13 preferably has a permeability of not more than 1% to visible light and ultraviolet rays ranging from 300 nm to 500 nm in wavelength. For this purpose, at least one of paper layers contains light absorbing or screening materials such as carbon blacks, dyestuffs, or inorganic materials whose refractive index is not less than 1.50, e.g. titanium oxide, barium sulfate and calcium carbonate. It is preferable to color the outermost paper layer 13*a* that is oriented outward when the cardboard paper 13 is folded into the casing 12, because it has the same effect as printing the outermost surface of the casing 12.

It is also preferable to provide a polymeric layer 14 with a low vapor permeability on the outermost paper layer 13*a* by laminating, coating or printing. Thereby, the vapor permeability of the cardboard paper 13 and thus that of the casing 12 are lowered, so humidity inside the casing 12 varies less. This contributes to making the quality of prints more stable and independent of the humidity of the atmosphere. It is to be noted that the polymeric layer 14 is preferably provided only on one side of the cardboard paper 13, that is, on the outermost paper layer 13*a*. By not providing such a moisture tight polymeric layer on the opposite surface of the cardboard paper 13 that is oriented inward of the casing 12, the internal humidity of the casing 12 is kept constant due to the moisture retention of the cardboard paper 13. As the moisture tight polymeric layer 14, polyester film such as polyethylene terephthalate, vinylidene chloride, vinyl chloride, polypropylene, polyethylene, polyvinyl alcohol and their copolymers. Ordinarily, a sufficient moisture proof effect is obtained when the polymeric layer 14 has a thickness of 0.005 mm to 0.06 mm. More preferably, the thickness of the polymeric layer 14 is 0.01 mm to 0.03 mm. The weight of the cardboard paper 13 is preferably 180 $g/m^2$ to 650 $g/m^2$, and more preferably 280 $g/m^2$ to 450 $g/m^2$, in view of stiffness and processability.

As the casing 12 is formed from the layered cardboard paper 13 whose outer surface is coated with the moisture tight polymeric layer 14, the recoding paper package 10 having the above configuration is superior in moisture proof, impact strength, and torsion strength. Moreover, since the inside surface of the casing 12 is not coated with such a moisture tight layer, the moisture absorption property of the cardboard paper 13 itself is effectively utilized for keeping the internal moisture condition of the casing 12 constant.

It is preferable to equalize the friction factor between the inside surface of the casing 12 and the recording sheet 11 to the friction factor between the recording sheets 11, for the sake of stable feeding of the recording sheet 11. Specifically, the friction factor between the inside surface of the casing 12 and the recording sheet 11 should not more than 20% differ from the friction factor between the recording sheets 11. If the friction factor between the inside surface of the casing 12 and the recording sheet 11 is more than 20% larger than the friction factor between the recording sheets 11, the last recording sheet 11 to feed would not smoothly slide out of the casing 12. If, on the contrary, the friction factor between the inside surface of the casing 12 and the recording sheet 11 is more than 20% smaller than the friction factor between the recording sheets 11, the recording sheets 11 tend to be fed out together from the casing 12.

A label 29 indicating information on the recording sheets 11 contained in the casing 12 is put onto the outer surface of the casing 12, e.g. on the bottom wall half 20*d* in the embodiment shown in FIG. 3A. In this embodiment, a bar code 29*a* representative of the paper information is printed on the label 29, so that the thermal printer can read the paper information from the bar code 29*a*. The paper information may include the type and format of the recording sheets 11 or heat-sensitivity or photo-sensitivity of the recording sheets 11.

A bar code window 44 made of a transparent plastic is formed in a portion of a bottom wall 35*a* of the cassette body 35, so that the bar code label 29 of the recording sheet package 10 loaded in the package chamber 38 is opposed to the bar code window 44.

Figure 7:
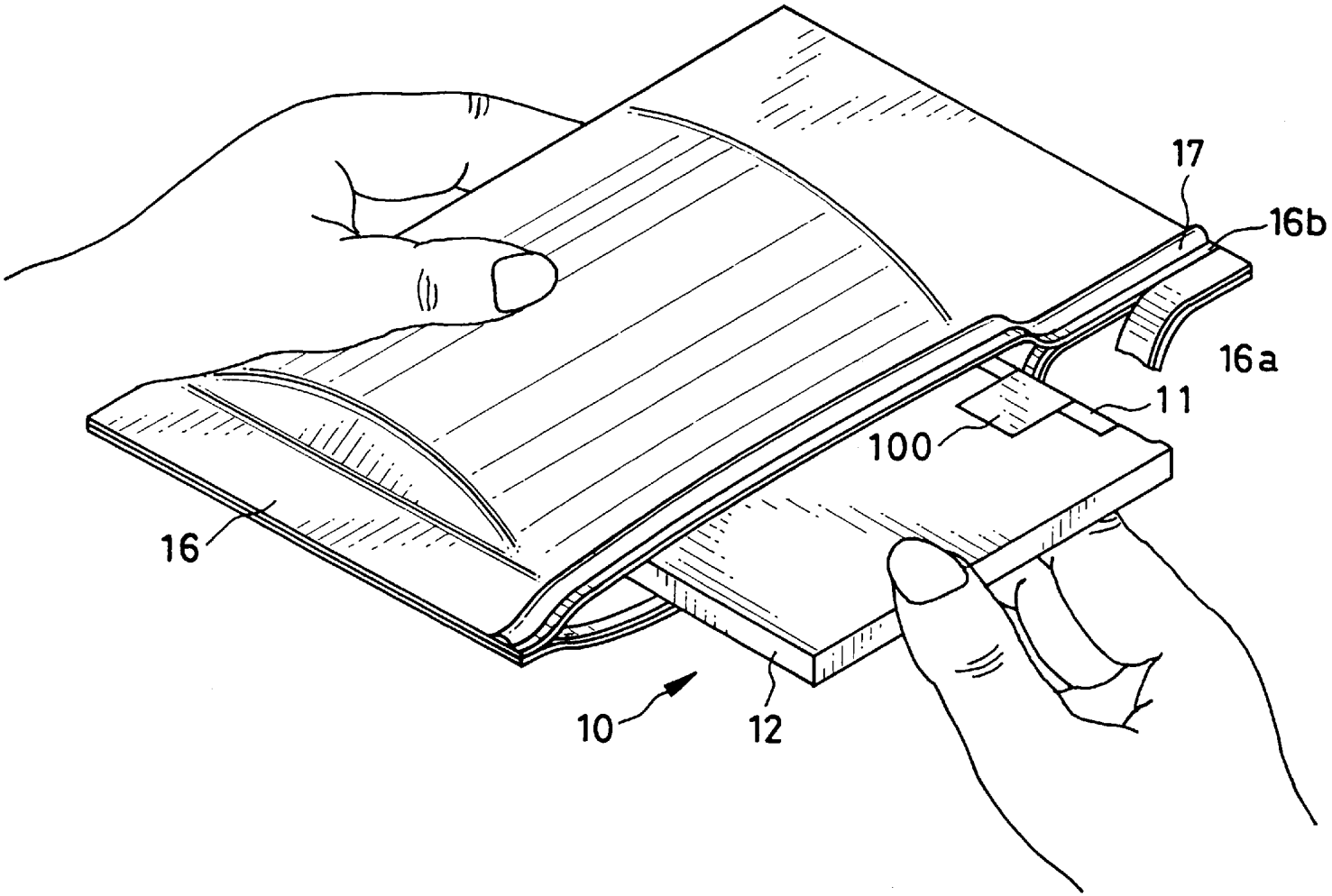
FIG. 7 is an explanatory diagram illustrating a packing bag of the recording sheet package.

As shown in FIG. 7, the recording sheet package 10 is packed in a light-tight and moisture-tight packing bag 16 while it is on sale. The packing bag 16 is opened by cutting off a margin 16*a* along a cutting line 16*b*. To enable packing the recording sheet package 10 again in the packing bag 16, a plastic sealing member 17 is provided along the cutting line 16*b* on opposite side of the margin 16*a*.

To prevent the recording sheets 11 from slipping off the casing 12 after the recording sheet package 10 is taken out of the packing bag 16, an adhesive tape 100 is put across the paper feed-out opening 22. The adhesive tape 100 should be smoothly removable from the recording sheets 11 and the casing 12. By putting the adhesive tape 100 across the paper feed-out opening 22, the movable bottom plate 21*a* is kept in tight contact with the recording sheet 11, so the recording sheets 11 are more tightly shielded from light and moisture.

Figure 8:
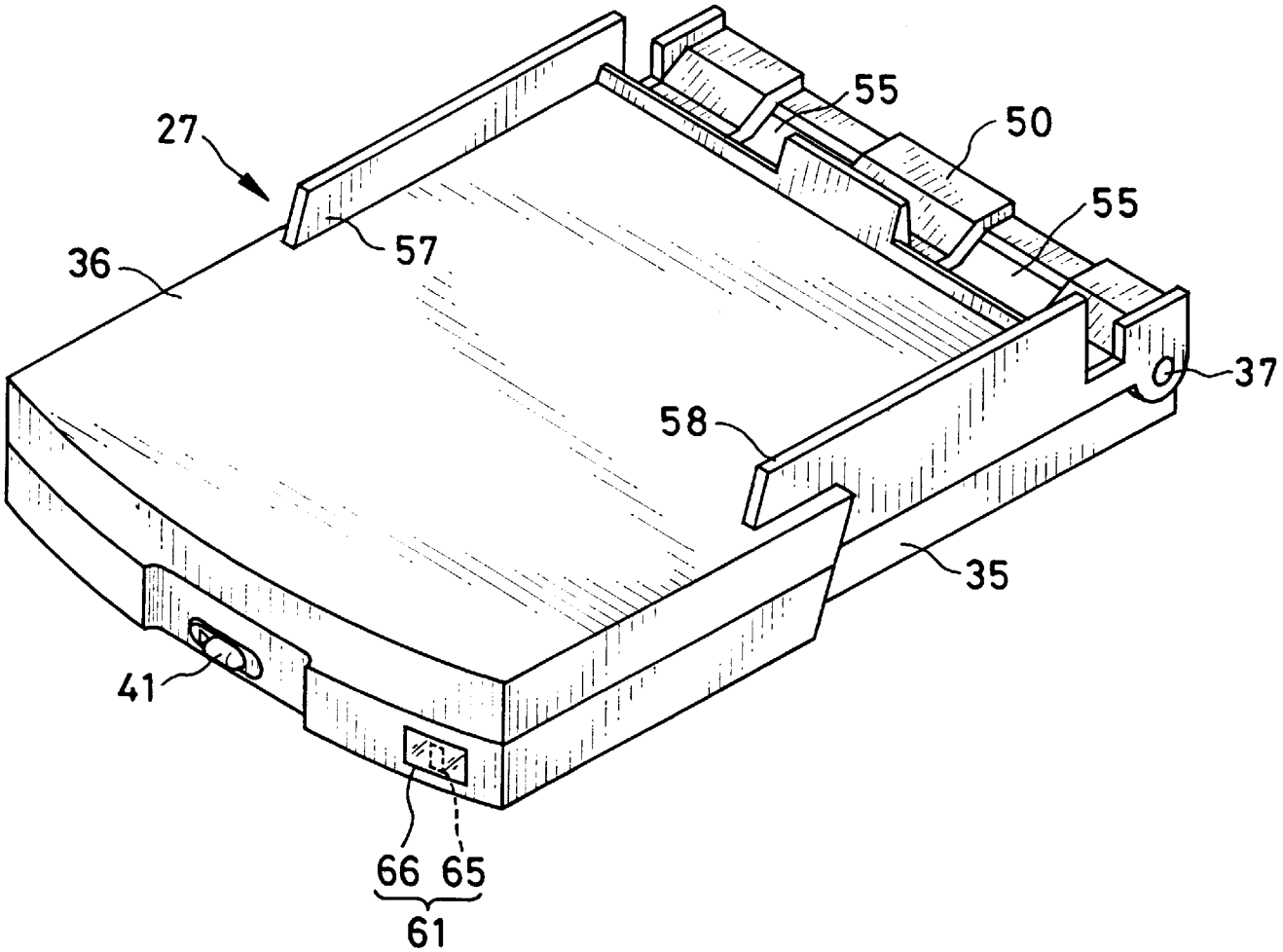
FIG. 8 is a perspective view of the paper feeding cassette in its closed position.

As shown in FIGS. 1 and 8, the paper feeding cassette 27 is constituted of a cassette body 35 and a lid 36 that is mounted to the cassette body 35 through a hinge 37. The lid 36 is opened to load the recording sheet package 10 in a package chamber 38 of the cassette body 35. When the lid 36 is closed, engaging claws 39 of the lid 36 are engaged with a lock device 40 of the cassette body 35, to keep the lid 36 in the closed position. By sliding an unlock button 41, the lock device 40 is disengaged from the engaging claws 39, so the lid 36 is unlocked.

To facilitate loading, the package chamber 38 is slightly larger than the recording sheet package 10. A positioning projection 42 is formed on one side wall of the cassette chamber 38. Correspondingly, a positioning mark 43 is provided on the recording sheet package 10 at the top wall 20*a* of the outer casing member 20. The recording sheet package 10 is loaded in the package chamber 38 while putting the positioning mark 43 in opposition to the positioning projection 42.

The push-up plate 28 is mounted in the package chamber 38 through a mounting device 46 that supports one end of the push-up plate 28. Coiled springs 47 are mounted below another end of the push-up plate 28 to urge the push-up plate 28 to move upward. The push-up plate 28 is made of a resilient material, so the push-up plate 28 and the coiled springs 47 are pushed down by the recording sheet package 10 when the lid 36 is closed after the recording sheet package 10 is loaded in the package chamber 38. In this closed position, the push-up plate 28 resiliently pushes up the movable bottom plate 21*a* of the recording sheet package 10, as shown in FIG. 5.

As shown in FIG. 5, a gap or slit 50 is provided between the cassette body 35 and the lid 36 on the side of the hinge 37, to constitute a paper exit 50. Behind the paper exit 50, a recording sheet separating device 51 is provided for preventing a plurality of recording sheets 11 from being fed out concurrently. As shown in FIG. 1, a rubber block 52 is provided in a middle portion of the recording sheet separating device 51. The rubber block 52 has a top surface 52*a* that is inclined in the paper feeding direction, and is protruded upward into a paper feeding path behind the paper exit 50. If more than one recording sheet 11 are fed out from the recording sheet package 10, the lower one of the recording sheets 11 is stopped from sliding out of the paper exit 50 because of the friction of the rubber block 52 against the recording sheet 11. The recording sheet separating device 51 further has separating projections 53 on opposite sides of the rubber block 52*a*. Leading edges of the lower ones of those recording sheets 11 which are fed out together from the recording sheet package 10 strike against the separating projections 53, so only the topmost recording sheet 11 can move past the recording sheet separating device 51.

Figure 9:
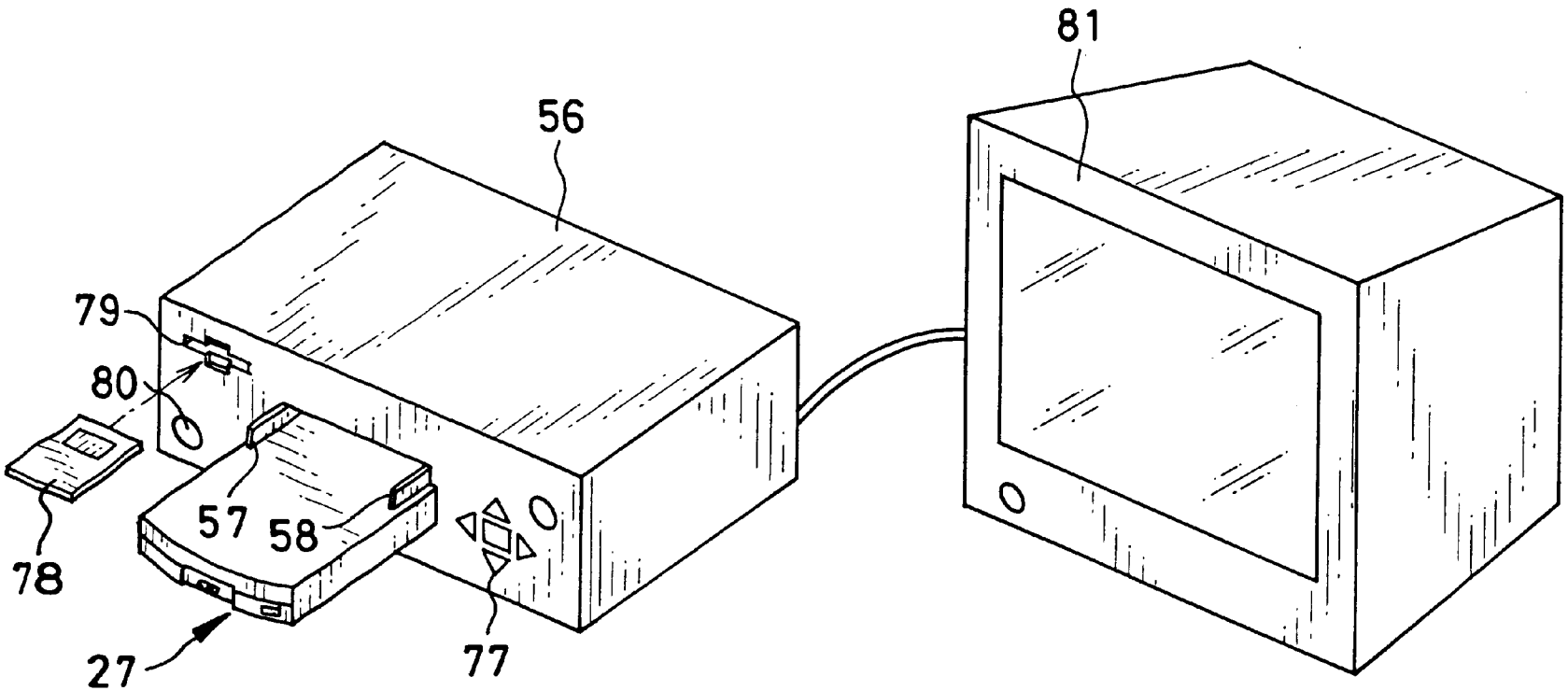
FIG. 9 is a schematic diagram illustrating the paper feeding cassette attached to a thermal printer with a CRT display device connected thereto.

As shown in FIGS. 1 and 8, a pair of roller openings 55 are formed through the lid 36, such that the feed roller entrance 25 of the recording sheet package 10 is located under the roller openings 55. When the paper feeding cassette 27 is attached to a thermal printer, as shown for example in FIG. 9, the feed rollers 24 of the thermal printer 56 is brought into contact with the topmost recording sheet 11 of the recording sheet package 10 through the roller openings 55 and the paper entrance 25. As the feed rollers 24 rotate in a paper feeding direction, the topmost recording sheet 11 is fed out from the recording sheet package 10 into the thermal printer 56.

The recording sheet 11 after having a picture printed thereon through the thermal printer 56 is ejected onto the top wall of the lid 36 of the paper feeding cassette 27. To guide and stop the ejected recording sheet 11 from dropping off, a pair of guide fences 57 and 58 are provided on the opposite sides of the top wall of the lid 36. That is, the top wall of the lid 36 doubles as a paper ejection tray.

Figure 10:
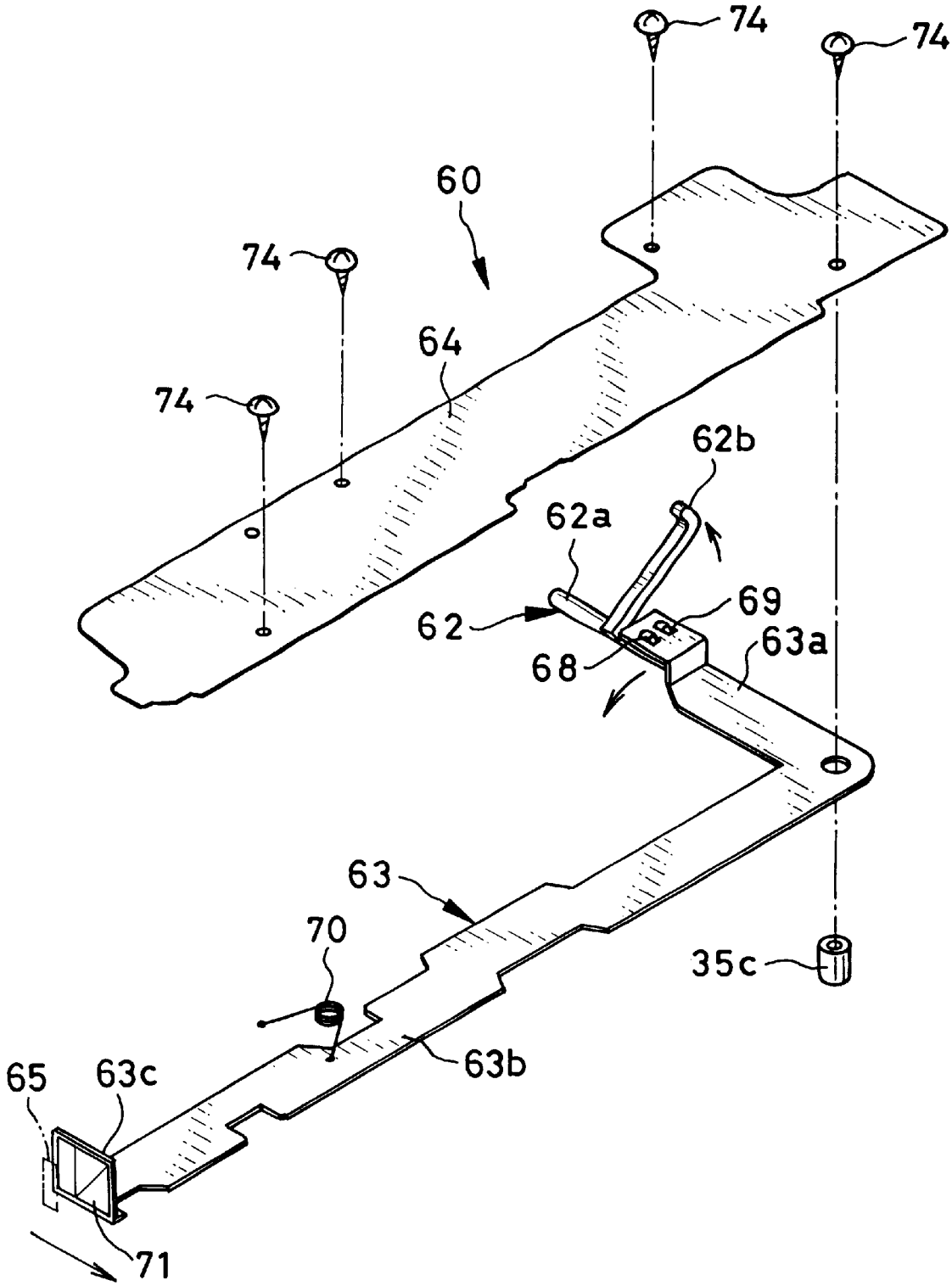
FIG. 10 is an exploded perspective view illustrating a paper remainder indication device incorporated into the paper feeding cassette.

As shown in detail in FIG. 10, a paper remainder indication device 60 and a paper remain indication window 61 are provided in the paper feeding cassette 27. The paper remainder indication device 60 is constituted of the paper remainder detection lever 62, a paper remainder indication lever 63 and a holding plate 64. As shown in FIG. 8, the paper remainder indication window 61 is constituted of a rectangular hole 65 formed through an end wall of the cassette body 35, and a transparent plastic plate fitted onto the end wall in front of the rectangular hole 65.

Figure 11:
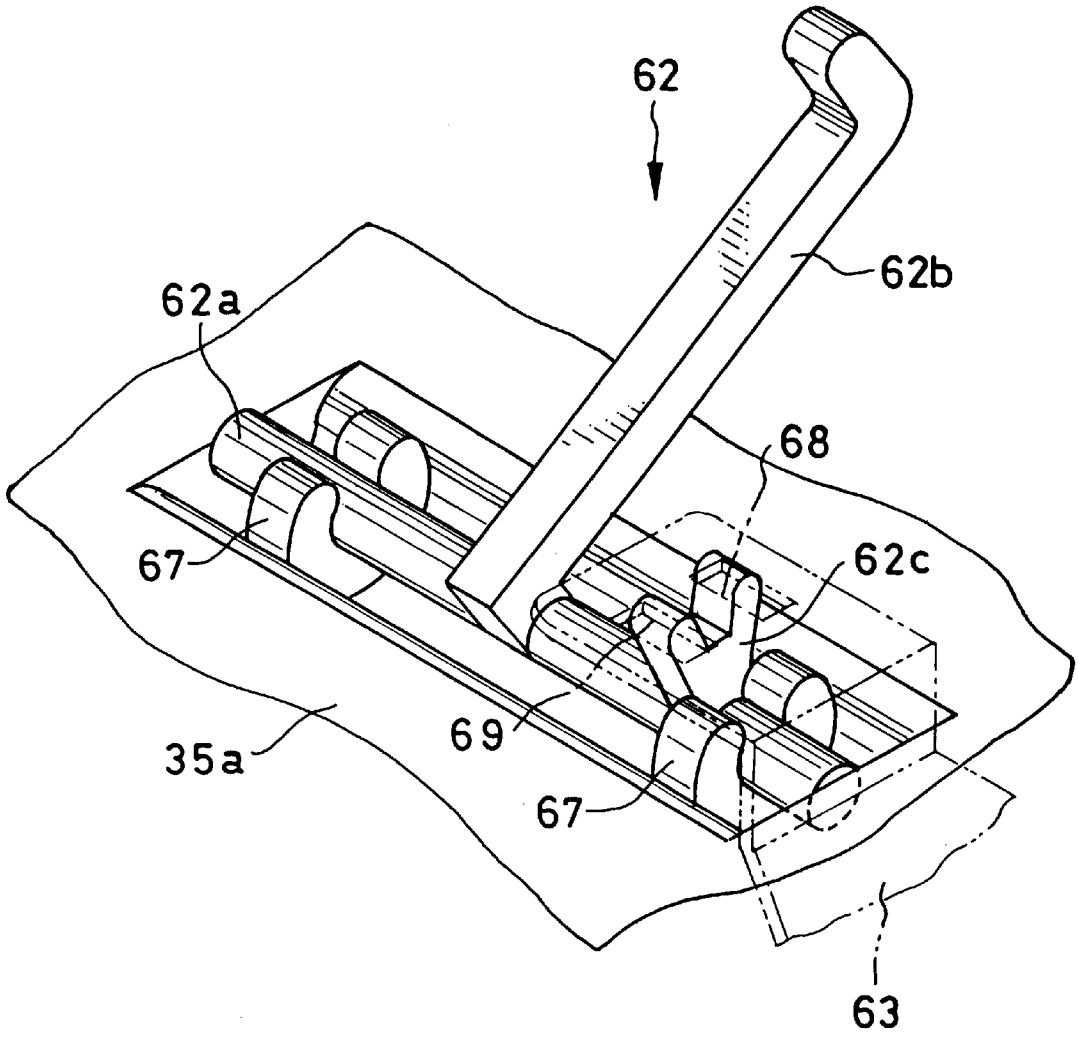
FIG. 11 is an enlarged perspective view of a paper remainder detection lever of the paper remainder indication device of FIG. 10.

As shown in FIG. 11, the paper remainder detection lever 62 is an integral part consisting of a mounting shaft 62*a*, a detection arm 62*b* and an engaging fork 62*c* which are radially protruded from the mounting shaft 62*a*. The mounting shaft 62*a* is rotatably held in a bearing portion 67 that is provided on the bottom wall 35*a* of the cassette body 35.

Referring back to FIG. 10, the paper remainder indication lever 63 consists of an engaging arm section 63*a* and an indication arm section 63*b* which extend orthogonally to each other, and is mounted rotatably on a pivot 35*c* that is provided on the bottom wall 35*a* of the cassette body 35. The holding plate 64 is mounted on the paper remainder indication lever 63, and is secured to the pivot 35*c* by a screw 74. A coiled spring 70 that is suspended between this lever 63 and the bottom wall 35*a* urges the paper remainder indication lever 63 to rotate about the pivot 35*c* in a counterclockwise direction in FIG. 10.

The engaging fork 62*c* of the paper remainder detection lever 62 is engaged with a pair of holes 68 and 69 that are formed through an end of the engaging arm section 63*a* of the paper remainder indication lever 63. Thus, the rotational movement of the paper remainder detection lever 62 is transmitted to the paper remainder indication lever 63. Since the indication arm section 63*b* is quite longer than the engaging arm section 63*a*, a small motion of the engaging arm section 63*a* is converted into a larger motion of a distal end of the indication arm section 63*b*. The distal end of the indication arm section 63*b* is bent rectangularly to provide an indicator blade 63*c*, and an indication label 71 is put on this indicator blade 63*c*. The indicator blade 63*c* is located behind the paper remainder indication window 61 such that the indication label 71 is partly viewed through the hole 65.

As shown in FIG. 1, a distal end of the detection arm 62*b* protrudes upward through a cutout 28*a* of the push-up plate 28, and comes to contact with the bottom of the pile of the recording sheets 11 when the recording sheet package 10 is loaded in the paper feeding cassette 27. As the recording sheets 11 are sequentially fed out from the recording sheet package 10, and thus the remaining number of recording sheets 11 decreases, the pile of the recording sheets 11 is pushed upward by the push-up plate 28 through the movable bottom plate 21*a*. As a result, the detection arm 62*b* moves upward while rotating about the shaft 62*a* in a counterclockwise direction in FIG. 10. Thereby, the paper remainder indication lever 63 rotates in the counterclockwise direction according to the force of the coiled spring 70, so the indicator blade 63*c* and thus the indication label 71 moves in a direction shown by an arrow in FIG. 10.

Figure 12A:
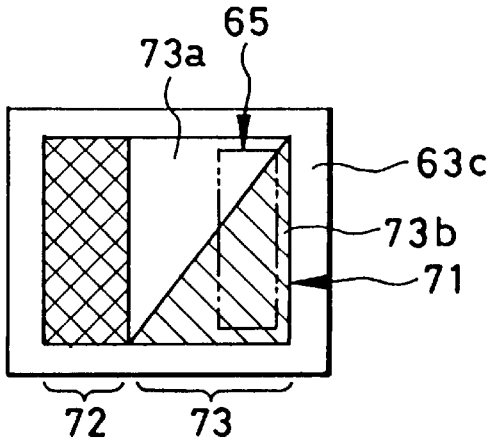
FIGS. 12A, 12B and 12C are explanatory diagrams illustrating how the paper remainder indication device indicates the amount of the recording sheets that remainder in the recording sheet package.
Figure 12B:
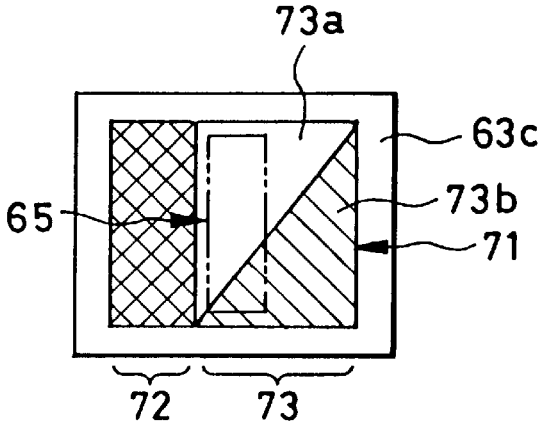
Figure 12C:
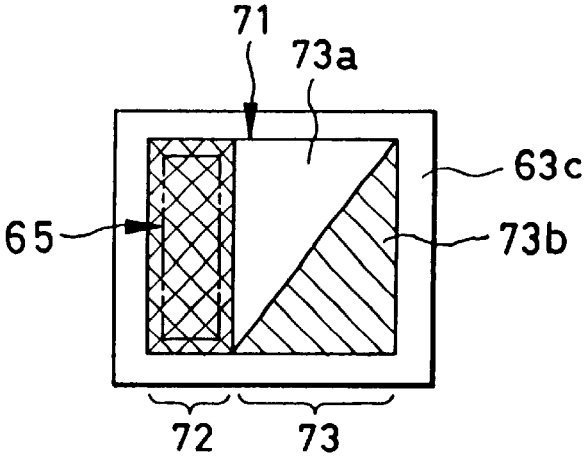

As shown in FIGS. 12A to 12C, the indication label 71 has a pattern printed thereon. The pattern consists of a first indication area 72 for indicating that there are not any recording sheets 11 in the recording sheet package 10, and a second indication area 73 for indicating the remaining amount of recording sheet 11. The whole first indication area 72 is colored in a single color, e.g. red, whereas the second indication area 73 sectioned diagonally into two triangular segments 73*a* and 73*b* of different colors, e.g. white and green.

Immediately after the recording sheet package 10 is newly loaded in the paper feeding cassette 27, the indicator blade 63*c* is set in a position shown in FIG. 12A, wherein the lower green triangular segment 73*b* of the second indication area 73 occupies most of an area visible through the paper remainder indication window 61. As the remaining amount of recording sheets 11 decreases, the indicator blade 63*c* moves toward a position as shown in FIG. 12B, wherein the second indication area 73 is still viewed through the paper remainder indication window 61, but the upper white triangular segment 73*a* occupies most of the area visible through the hole 65. That is, the occupation rate of the green segment 73*b* within the visible area of the paper remainder indication window 61 represents the amount of recording sheets 11 remaining in the paper feeding cassette 27. After the last recording sheet 11 is fed out, the indicator blade 63*c* moves to a position shown in FIG. 12C, wherein the red first indication area 72 is placed behind the hole 65 of the paper remainder indication window 61, indicating that there are not any recording sheets 11 in the paper feeding cassette 27.

When making a print, a power switch 80 of the thermal printer 56 is turned on, and necessary commands are entered by operating some keys 77 of the thermal printer 56. First, an image to print is displayed on an external display device 81, such as a CRT monitor, connected to the thermal printer 56. The image is displayed on the basis of image data that is sent from another device or read out from a memory medium, e.g. a smart media 78 inserted in a slot 79 of the thermal printer. The operator confirms the image to print on the display device 81, and operates a print start key included in the keys 77.

Then, the feed rollers 24 start rotating to feed the topmost recording sheet 11 in the recording sheet package 10 out of the paper feeding cassette 27 into the thermal printer 56. The thermal printer 56 then prints the image on the recording sheet 11 according to a conventional three color frame sequential method. In this embodiment, the thermal printer 56 is a direct color thermal printer using the thermosensitive color recording sheet, so each color frame is recorded by heating the recording sheet 11 by a thermal head, and thereafter fixed by an optical fixing device. The recording sheet 11 having the image recorded thereon is ejected onto the lid 36 of the paper feeding cassette 27.

As the remaining amount of the recording sheets 11 decreases, the movable bottom plate 21*a* of the casing 12 is pushed up by the push-up plate 28 of the paper feeding cassette 27. Therefore, the topmost recording sheet 11 in the pile is always pressed onto the feed rollers 24. On the other hand, the pressing plate 21*c* and the spring flaps 21*e* of the casing 12 keep on pressing down the recording sheets 11. Therefore, the recording sheets 11 are kept in tight contact with each other, so the recording sheets 11 are well protected from moisture and extraneous light. Since the movable bottom plate 21*a* of the inner casing member 21 is kept in tight contact with the recording sheets 11, the recording sheets 11 is protected from dust, even though the outer casing member 20 has the push-up plate entrance 26 in the bottom side thereof.

To use another type paper for printing, the paper feeding cassette 27 is detached from the thermal printer 56, and the recording sheet package 10 is replaced by another type of recording sheet package. The half-used recording sheet package 10 can be packed again in the packing bag 16 and is sealed by closing the sealing member 17, to preserve it while protecting it from moisture and light.

Figure 13A:
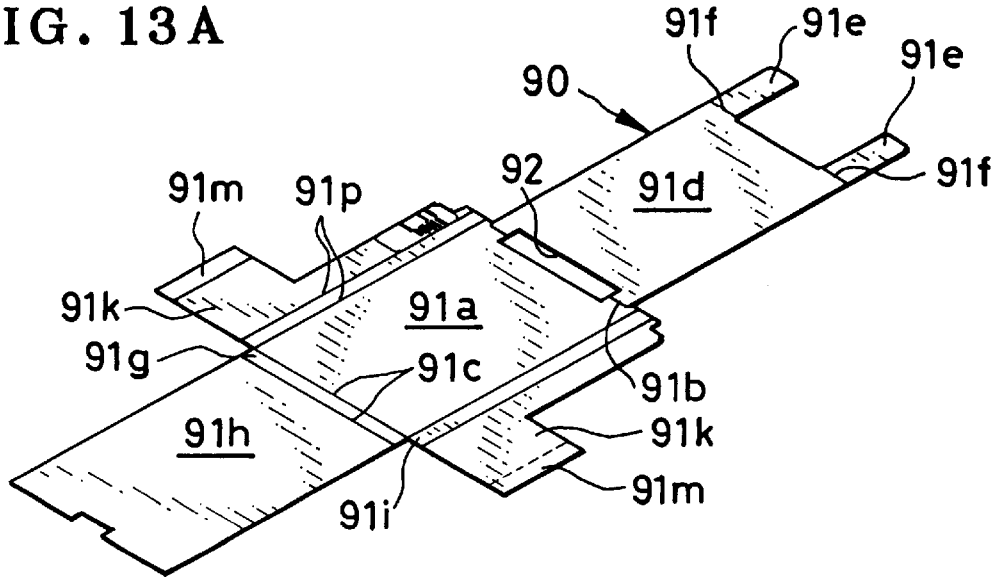
FIGS. 13A, 13B and 13C are explanatory diagrams illustrating how to make a casing of a recording sheet package according to a second embodiment of the invention.
Figure 13B:
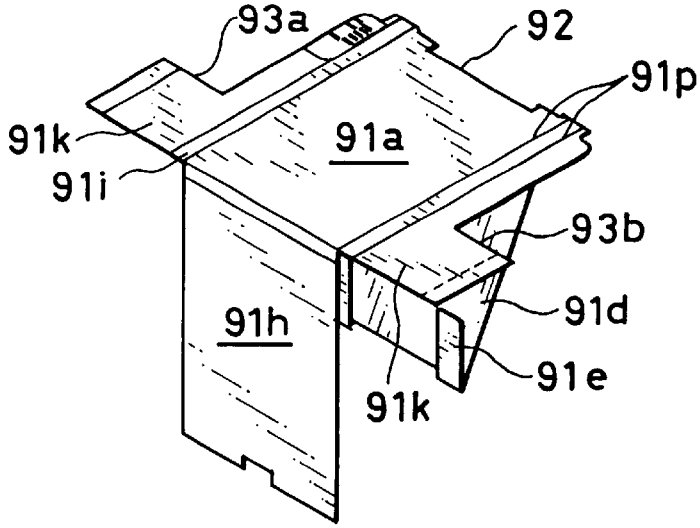
Figure 13C:
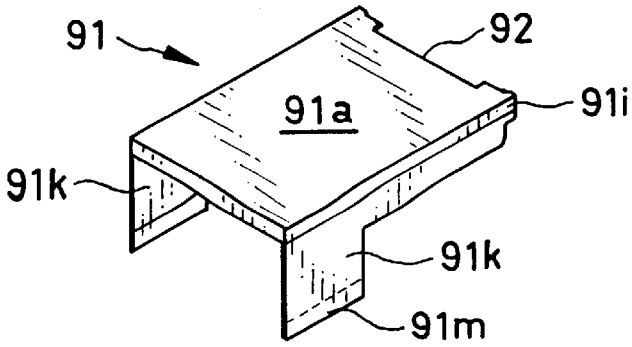

Although the casing 12 of the recording sheet package 10 is constituted of the inner and outer casing members 20 and 21, it is possible to form a casing 91 from a single blanked piece 90 of cardboard paper, as shown in FIGS. 13A to 13C. According to this embodiment, a pressing plate 91*d* is connected to a top wall 91*a*. An opening 92, that provides a feed roller entrance and a paper exit as well, is formed between the top wall 91*a* and the pressing plate 91*d*. A pair of spring flaps 91*e* are connected to the pressing plate 91*d*. Also, an end wall portion 91*g* is connected to the top wall 91*a* on opposite side from the pressing plate 91*d*, and a movable bottom plate 91*h* is connected to the end wall portion 91*g*. Side walls 91*j* are connected to the top wall 91*a*, and bottom wall halves 91*k* are connected to the side walls 91*j*, in the same way as the outer casing member 20 of the first embodiment.

To form the casing 91, the cardboard plate 90 is first folded along folding lines 91*f* to bend the spring flaps 91*e* downward, and then folded along folding lines 91*b* to place the pressing plate 91*d* under the top wall 91*a*, as shown in FIG. 13B. Thereafter, the cardboard plate 90 is folded along folding lines 91C at an angle of 90° to place the movable bottom plate 91*h* below the pressing plate 91*d* that is placed under the top wall 91*a*, as shown in FIG. 13C. Then, a pile of recording sheets are inserted into between the pressing plate 91*d* and the movable bottom plate 91*h* with their recording surfaces oriented downward.

Next, the cardboard plate 90 is folded along folding lines 91*p* such that the side walls 91*j* and the bottom wall halves 91*k* are wrapped around the recording sheets and the movable bottom plate 91*h*. Thereafter, paste margins 91*m* of the bottom wall halves 91*k* are bonded to each other. Then cutouts 93*a* and 93*b* of the bottom wall halves 91*k* form a push-up plate entrance.

Although the bottom wall halves 20*d* and 20*e*, or 91*k* are approximately equal in size to each other, they may have different sizes from each other. The bonding position of the casing is not necessarily located in the bottom, but may be located in another position. For example, it is possible to locate the bonding position between a bottom wall portion and a side wall portion, or between a side wall portion and a top wall portion.

Although the recording sheets are fed out from the recording sheet package by the feed rollers that are provided in the thermal printer in the above embodiment, the recording sheet package of the present invention may be loaded in a paper feeding cassette having feed rollers incorporated therein.

The present invention is applicable to a recording sheet package for the thermal wax transfer type printer or the sublimation type thermal printer.

Thus, the present invention is not to be limited to the above embodiments but, on the contrary, various modification will be possible to those skilled in the art without departing from the scope of claims appended hereto.

What is claimed is:

1. A recording sheet package containing a pile of recording sheets in a box-shaped casing, the recording sheet package being loaded in a paper feeding cassette of a thermal printer, to feed the recording sheets into the thermal printer, the recording sheet package comprising:

a paper feed-out opening formed in one end of the casing;

a feed roller entrance formed through a top wall of the casing in connection to the paper feed-out opening, for allowing a feed roller of the paper feeding cassette or that of the thermal printer to access a topmost one of the piled recording sheets;

a movable bottom plate on which the recording sheets are piled up, the movable bottom plate being disposed on a bottom wall of the casing that extends parallel to the top wall, so as to be able to flap up and down relative to the bottom wall;

a push-up plate entrance formed through the bottom wall in connection to the paper feed-out opening, for allowing a push-up plate of the paper feeding cassette to push up the movable bottom plate and press the topmost recording sheet onto the feed roller; and a pressing plate disposed under the top wall so as to be able to flap up and down relative to the top wall, the pressing plate pressing the pile of recording sheets onto the movable bottom plate.

2. A recording sheet package as claimed in claim 1, wherein the movable bottom plate is sized to be equal to or slightly larger than the recording sheet.

3. A recording sheet package as claimed in claim 2, wherein the recording sheets are piled up with their recording surfaces oriented toward the movable bottom plate.

4. A recording sheet package as claimed in claim 1, wherein the pressing plate has a pair of spring flaps that are formed integrally with the pressing plate from a cardboard paper by folding the cardboard paper, the pressing plate being urged toward the pile of recording sheets because of a spring force of the spring flaps that is given by a stiffness of the cardboard paper.

5. A recording sheet package as claimed in claim 4, wherein the cardboard paper has a weight of 180 $g/m^2$ to 650 $g/m^2$.

6. A recording sheet package as claimed in claim 5, wherein the cardboard paper has a permeability of not more than 1% to light of a wavelength range from 300 nm to 500 nm.

7. A recording sheet package as claimed in claim 5, wherein the casing is constituted of an outer casing member of a rectangular barrel shape and an inner casing member, each of the casing members being formed by folding and bonding a blanked piece of the cardboard paper, wherein the outer casing member consists of the top wall, the bottom wall, side walls connecting the top wall to the bottom wall, whereas the inner casing member consists of the pressing plate, the movable bottom plate and an end wall portion connecting the pressing plate to the movable bottom plate, the inner casing member being located inside the outer casing member such that an open end of the outer casing member on the opposite side from the paper feed-out opening is closed by the end wall portion of the inner casing member.

8. A recording sheet package as claimed in claim 7, wherein the pressing plate has a pair of spring flaps that are formed integrally with the pressing plate and are folded into the pressing plate and the movable bottom plate, the spring flaps pressing the pile of recording sheets down to the movable bottom plate because of a spring force of the spring flaps that is given by a stiffness of the cardboard paper.

9. A recording sheet package as claimed in claim 8, wherein the pressing plate has a pair of spring flaps that are formed integrally with the pressing plate and are folded into between the pressing plate and the top wall, the pressing plate being urged toward the pile of recording sheets because of a spring force of the spring flaps that is given by a stiffness of the cardboard paper.

10. A recording sheet package as claimed in claim 5, wherein the casing is formed by folding and bonding a blanked piece of the cardboard paper, wherein the pressing plate is connected to one end of the top wall through a folding line, and the feed roller entrance is formed on the folding line between the pressing plate and the top wall, whereas the movable bottom plate is connected to another end of the top wall through an end wall portion that extends rectangular to the top wall, and the bottom wall is connected to the top wall through side walls, the side and bottom walls being wrapped around the movable bottom plate after the pressing plate and the movable bottom plate are formed by folding.

11. A recording sheet package as claimed in claim 1, wherein the casing is made from a cardboard paper having a moisture tight polymeric layer formed on one side thereof, such that the moisture tight polymeric layer is oriented outward of the casing.

12. A recording sheet package as claimed in claim 11, wherein the polymeric layer has a thickness of 0.005 mm to 0.06.

13. A recording sheet package as claimed in claim 1, wherein the movable bottom plate has a cutout or opening for allowing a paper remainder detection member of the paper feeding cassette to access the recording sheets and detect the amount of recording sheets that remain in the recording sheet package.

* * * * *